US008899155B2

(12) United States Patent
Mutascio

(10) Patent No.: US 8,899,155 B2
(45) Date of Patent: Dec. 2, 2014

(54) CONSUMABLE AMMUNITION ASSEMBLY HAVING A NITROGUANIDINE CASE AND METHOD OF MAKING A CONSUMABLE AMMUNITION ASSEMBLY HAVING A NITROGUANIDINE CASE

(75) Inventor: Enrico R. Mutascio, Palm Springs, CA (US)

(73) Assignee: Armtec Defense Products Co., Coachella, CA (US)

( * ) Notice: Subject to any disclaimer, the term of this patent is extended or adjusted under 35 U.S.C. 154(b) by 0 days.

(21) Appl. No.: 13/415,798

(22) Filed: Mar. 8, 2012

(65) Prior Publication Data

US 2012/0318161 A1 Dec. 20, 2012

Related U.S. Application Data

(60) Provisional application No. 61/450,884, filed on Mar. 9, 2011.

(51) Int. Cl.
*F42B 5/192* (2006.01)
*F42B 5/188* (2006.01)
*F42B 5/18* (2006.01)

(52) U.S. Cl.
CPC ..... *F42B 5/181* (2013.01); *F42B 5/188* (2013.01)
USPC ..... 102/431

(58) Field of Classification Search
USPC ..... 102/430, 431, 432, 439, 464, 465, 282
See application file for complete search history.

(56) References Cited

U.S. PATENT DOCUMENTS

| | | | | |
|---|---|---|---|---|
| 3,474,702 | A | 10/1969 | Remaly et al. | |
| 3,676,233 | A * | 7/1972 | Netzer et al. | 149/19.91 |
| 4,365,558 | A | 12/1982 | Lippler et al. | |
| 5,403,035 | A | 4/1995 | Hamilton | |
| 6,600,002 | B2 * | 7/2003 | Sanderson et al. | 528/78 |
| 7,913,625 | B2 * | 3/2011 | Mutascio | 102/431 |
| 8,136,451 | B2 * | 3/2012 | Mutascio | 102/431 |
| 8,430,033 | B2 * | 4/2013 | Mutascio | 102/431 |
| 2001/0047072 | A1 | 11/2001 | Sanderson et al. | |
| 2007/0289474 | A1 | 12/2007 | Mutascio | |

FOREIGN PATENT DOCUMENTS

WO WO-2012122417 9/2012

OTHER PUBLICATIONS

International Searching Authority, International Search Report and Written Opinion, PCT Application PCT/US2012/028362, mailed Jun. 19, 2012, 8 pages.

* cited by examiner

*Primary Examiner* — James Bergin
(74) *Attorney, Agent, or Firm* — Perkins Coie LLP

(57) ABSTRACT

The present disclosure describes various embodiments of nitroguanidine-based consumable ammunition assemblies and methods of producing and using these assemblies. In one embodiment, for example, a nitroguanidine-based consumable ammunition assembly can include a projectile, a Combustible Cartridge Cased body using nitroguanidine as the primary energetic material, and a composite case base interfacing with the CCC body.

17 Claims, 1 Drawing Sheet

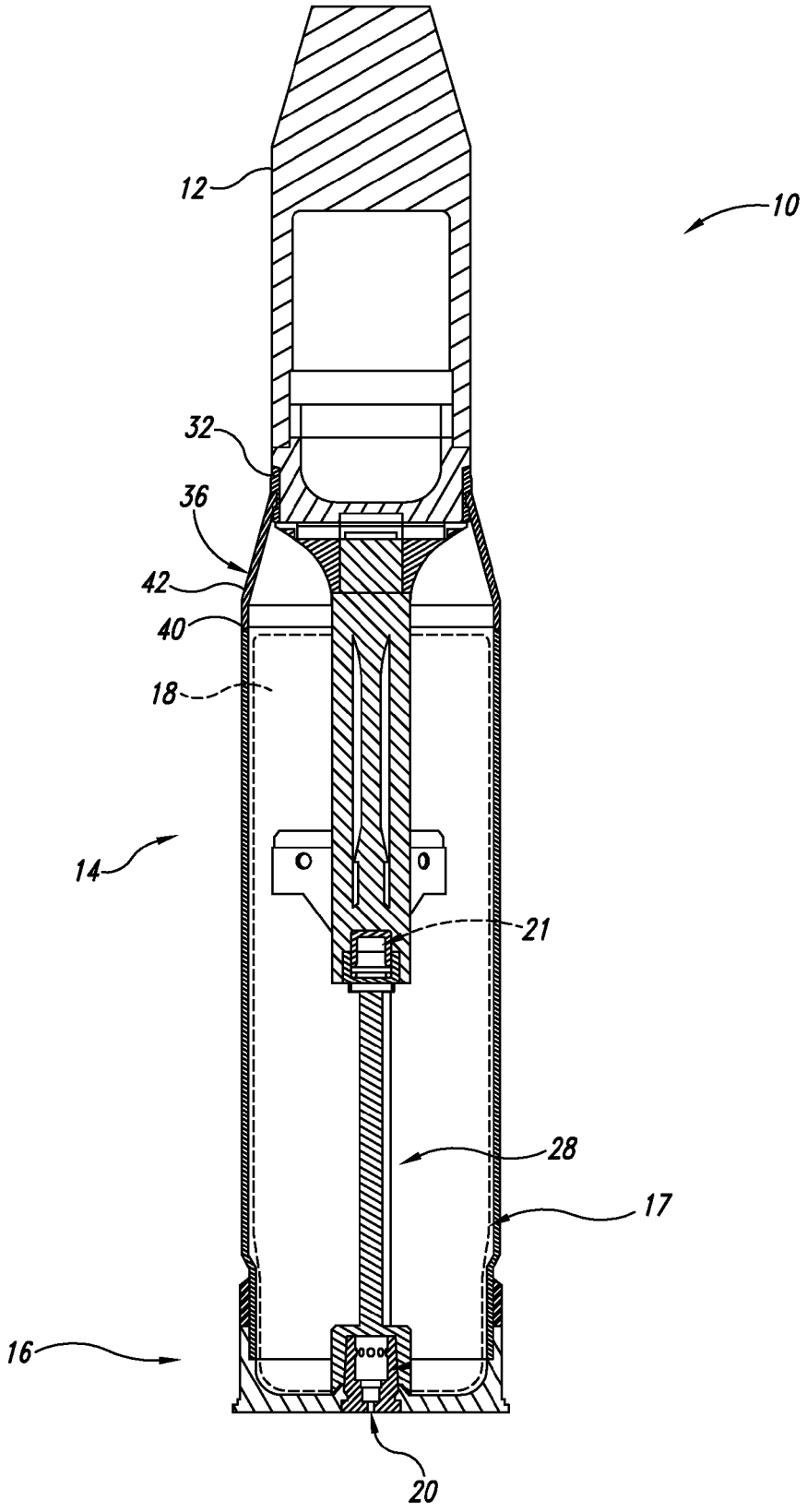
12
10
32
36
42
40
18
14
21
28
17
16
20

CONSUMABLE AMMUNITION ASSEMBLY HAVING A NITROGUANIDINE CASE AND METHOD OF MAKING A CONSUMABLE AMMUNITION ASSEMBLY HAVING A NITROGUANIDINE CASE

CROSS-REFERENCE TO RELATED APPLICATION

This application is a non-provisional patent application that claims priority to U.S. Provisional Patent Application No. 61/450,884, filed Mar. 9, 2011 and titled Consumable Ammunition Assembly Having A Nitroguanidine Case And Method Of Making A Consumable Ammunition Assembly Having A Nitroguanidine Case, which is incorporated herein in its entirety by reference thereto.

TECHNICAL FIELD

The present disclosure relates generally to consumable ammunition assemblies and, more particularly, to consumable ammunition rounds having casings made of energetic material.

BACKGROUND

Combustible Cartridge Cased (CCC) ammunition is widely used by the armed services. A typical CCC ammunition round can include three main components. The first is a projectile to be released upon firing. The second is a generally cylindrical CCC body that has a first end coupled to the projectile. The third is a composite case base interfacing with a second end of the CCC body. In some embodiments, the CCC body has been constructed from combustible materials including, for example, nitrocellulose. Specifically, in certain prior embodiments, the body has been constructed of approximately 60-67% nitrocellulose, approximately 25% structural fibers, and approximately 8-15% additives. Upon firing the CCC ammunition, the propellant is ignited by a primer (or other ignition device), and the burning propellant ignites the CCC body, such that the nitrocellulose oxidizes and burns at a temperature in the range of approximately 1,700° Celsius. The combustion of the CCC body generates high temperature, high pressure gas that works with the gas generated upon ignition of the propellant to drives the projectile.

SUMMARY

The present disclosure is directed to a nitroguanidine based consumable ammunition assembly and a method of making the ammunition assembly that overcomes drawbacks in the prior art and that provides other benefits. At least one aspect of the disclosure provides a consumable ammunition assembly, comprising a projectile having a leading portion and a trailing portion; a consumable cartridge body having a first end portion connected to the trailing portion of the projectile, a non-combustible base connected to a second end portion of the body and a propellant bed contained in the body and intermediate the projectile and the base. The consumable body comprises approximately 55%-70% energetic material, approximately 20%-30% non-energetic structural fibrous material; and 8%-15% additives, and wherein the energetic material comprises approximately 90%-100% nitroguanidine and approximately 0%-10% other energetic material different than nitroguanidine.

Another embodiment provides a consumable ammunition assembly comprising a projectile and a molded, consumable cartridge body having a first end portion connected to the projectile. The body is made of nitroguanidine-based energetic material and approximately 20%-30% non-energetic, fibrous material. The energetic material comprises approximately 90%-100% nitroguanidine. A non-combustible base is connected to second end portion of the body opposite the projectile. A propellant bed is contained in the body and intermediate the projectile and the base.

Another aspect provides a method of forming a fully consumable body for an ammunition assembly having the body intermediate a projectile and a non-consumable base. The method comprises mixing a slurry containing the nitroguanidine-based energetic material, structural fibers, and additives, wherein the slurry is supersaturated with nitroguanidine in solution, and the slurry includes nitroguanidine in suspension. The method includes passing the slurry over and through a screen having a shape of the body, and collecting the nitroguanidine-based energetic material, structural fibers, and additives on the screen in a substantially uniform thickness in the form of the body. The method can also include removing the screen with the body thereon from the slurry, allowing the body to at least partially dry after removal from the slurry, and removing the body from the mold screen.

BRIEF DESCRIPTION OF THE DRAWINGS

FIG. 1 is a cross-sectional view of a consumable cased ammunition assembly in accordance with an embodiment of the present invention.

DETAILED DESCRIPTION

The present disclosure describes various embodiments of nitroguanidine-based consumable ammunition assemblies and methods of producing and using these assemblies. In one embodiment, for example, a nitroguanidine-based consumable ammunition assembly can include a projectile, a consumable cartridge body using nitroguanidine as the primary energetic material, and a composite case base interfacing with the body.

Certain details are set forth in the following description and in FIG. 1 to provide a thorough understanding of various embodiments of the disclosure. Other details describing well-known structures and systems often associated with ammunition, ammunition assemblies, nitroguanidine, and energetic materials have not been set forth in the following disclosure to avoid unnecessarily obscuring the description of the various embodiments of the disclosure.

Many of the details and other features shown in the FIGURE are illustrative of particular embodiments of the disclosure. Accordingly, other embodiments can add other details and features without departing from the spirit or scope of the present invention. In addition, those of ordinary skill in the art will appreciate that further embodiments of the invention can be practiced without several of the details described below.

FIG. 1 is a cross-sectional view of a consumable ammunition assembly 10 in accordance with an embodiment of the disclosure. In the illustrated embodiment, the ammunition assembly 10 includes a projectile 12, a consumable body 14 at least partially engaging or otherwise being coupled to the projectile, and a case base 16 forming a closed-ended bottom of the ammunition assembly 10. The assembly 10 includes a propellant bed contained within the body, and a primer or other ignition device configured to ignite the propellant bed upon firing of the ammunition assembly.

The body 14 is fabricated from a consumable composite material, such as a resinated molded fiber composite made primarily of nitroguanidine, which is a fully consumable energetic component. Specifically, the body 14 can be fabricated with up to approximately 60-67% energetic material, approximately 25% structural fibers (e.g., abaca hemp fibers, Kraft paper fibers, or other suitable fibers), and approximately 8-15% additives, e.g. stabilizers and process aids such as Kymene. In other embodiments, different proportions of components can be used to effect different structural and material properties of the resultant body 14. For example, raising the structural fiber content while lowering the NQ content will raise the structural integrity but lower the cooling and propulsive benefits. Unlike conventional CCC fabrications, approximately 90-100% of the energetic material portion of the body can be nitroguanidine. In some embodiments, the remaining 0-10% of the energetic material can be nitrocellulose or other suitable energetic materials, such as RDX, HMX and the like.

Unlike conventional CCC bodies made of nitrocellulose, which oxidize and burn at high temperatures, the nitroguanidine does not burn via oxidation. In the embodiment described herein, upon firing the ammunition assembly 10, the propellant bed is ignited (via the primer), and as the propellant bed burns, the nitroguanidine in the body melts and fully decomposes to produce gas during deflagration of the body. The Nitroguanidine-based body releases about 25% more gas than conventional nitrocellulose-based bodies, and the temperature of the gas released from the nitroguanidine is about 1,000° Celsius cooler than the gas generated upon combustion of nitrocellulose. This increased production of gas provides increased drive applied to the projectile, as compared over traditional nitrocellulose assemblies, as the ammunition assembly is fired. The lower temperatures generated upon consumption of the nitroguanidine also results in substantially lower operating temperatures in the guns or other devices used to fire the assembly 10. These lower operating temperatures also help extend the life of the barrels in the guns firing the nitroguanidine-based ammunition assemblies 10. In addition, the fact that nitroguanidine does not burn/oxidize, it is an energetic material with reduce vulnerability to outside stimuli, thereby increasing its insensitivity and safety.

In accordance with aspects of the present disclosure, the nitroguanidine-based body 12 is formed on a mold. The process for forming the nitroguanidine-based body 12 includes providing a bath or slurry of solution (e.g., water) that includes the nitroguanidine-based energetic material, the structural fibers, and the additives. In one embodiment, the nitroguanidine-based energetic material, the fibers, and additives in the water bath are mixed using a hydropulper, although other suitable mixing techniques may be used. This slurry is supersaturated with nitroguanidine in solution, and the slurry includes nitroguanidine in suspension. The nitroguanidine in suspension is in crystalline format. In one embodiment, the nitroguanidine crystals are in low-bulk density needle crystalline form. Other embodiments can use nitroguanidine crystals in, as an example, high-bulk density spherical crystal form.

The slurry is flowing and is passed over and through a mold screen in the shape of the body. In another embodiment, the process can utilized performing screens, rather than mold screens. In at least one embodiment, the screen is shaped and sized to entrap the nitroguanidine crystals, the fiber material and the additive in the selected proportions, such that the material collects on the screen in a substantially uniform thickness. During this collection of materials on the mold screen, the nitroguanidine crystals effectively "knit" together and with the fibers and additives on the screen. In one embodiment, a vacuum system draws the components in the slurry through to a screen, such as a body-shaped mold screen, and the fibers accrete on the screen while the process water flows through the screen the nitroguanidine crystals are caught on the screen with the fibers and additives in a randomly-oriented matrix. The fiber matrix has sufficient density to ensure the structural integrity of the body 14. The mold is removed from the water bath or the water bath is drained. The body 14 is then allowed to at least partially dry and is detached from the screen. Drying can be accomplished under dry ambient conditions or by the use of an oven. In one embodiment, the body can then be further dried, coated, painted, or other wise processed after removal from the screen to provide the body in a format that can be assembled with the other components of the ammunition assembly.

The nitroguanidine-based ammunition assembly 10 can take numerous different forms. In some embodiments, for example, the nitroguanidine casing can function particularly well within alternate load path systems, such as the systems described by U.S. patent application Ser. No. 11/683,230, entitled "AMMUNITION ASSEMBLY WITH ALTERNATE LOAD PATH," which is incorporated by reference in its entirely. In one embodiment, for example, the body 14 and the case base 16 define an interior area 17 that contains a propellant charge 18 (partially shown in phantom lines for purposes of clarity). The ammunition assembly 10 further includes a structural member 28 that interconnects the projectile 12 and the case base 16. The structural member 28 forms an alternate load path to transmit at least one of a compression, tension, torsion, and bending force between the projectile 12 and the case base 16. The ammunition assembly 10 further includes an ignition device 20 (e.g. a primer) that can ignite the propellant charge 18 upon firing. Optionally, the ammunition assembly 10 can further include a tracer 21 positioned between the structural member 28 and the projectile 12.

In the one embodiment, the nitroguanidine-based, consumable body 14 can be a one-piece body. In other embodiments, the nitroguanidine-based, consumable body 14 can be a two-piece body with a proximal component 36 and a distal component 38 interconnected at a joint area generally adjacent to the projectile. In one embodiment, the joint area is formed by a skive joint 40 and an adhesive, fasteners, or other securing means. The proximal component 36 has a tapered case shoulder 42 and an open end 32 shaped and sized to removeably receive at least a portion of the projectile 12. The open end 32 can have various conventional features for engaging the projectile 12, including, for example, hangers, threads, holes, grooves, notches, etc. The other end of the body's proximal component has a diameter that generally corresponds with the diameter of the distal component to provide a smooth transition area on the body 14. The distal component 38 of the combustible body has a substantially cylindrical shape and an open end 34 shaped and sized to engage the case base 16.

Nitroguanidine-Based Body Formulation

At least one embodiment of the nitroguanidine-based material that makes up the body comprises, but is not limited to, the following formulation:

- Nitroguanidine—50-60%
- Other energetic material (e.g., nitrocellulose) 5-10%
- Fiber material (e.g., Kraft paper fibers)—20-30%
- Additives—Kymene 2%, Stabilizer (ethyl centralite/methyl nitro aniline/Akardite 1-3%, & evaporating solvents)

In another embodiment, the nitroguanidine-based material that makes up the body comprises, but is not limited to, the following formulation:

Nitroguanidine—50-60%

Other energetic material (e.g., nitramines (HMX, RDX, CL-20)—5-10%

Fiber material (e.g, synthetic fibers (polyester/acrylic/Celcon))—20-30%

Additives—e.g., Kymene 5%, Stabilizer (ethyl centralite/methyl nitro aniline/Akardite 1-3%, carboxy methyl cellulose 5%)

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A consumable ammunition assembly, comprising:

a projectile having a leading portion and a trailing portion;

a consumable cartridge body having a first end portion connected to the trailing portion of the projectile, and the body having a second end opposite the first end, wherein the body comprises approximately 55%-70% energetic material, approximately 20%-30% non-energetic structural fibrous material; and 8%-15% additives, and wherein the energetic material comprises approximately 90%-100% nitroguanidine and approximately 0%-10% other energetic material different than nitroguanidine;

a non-combustible base connected to the second end portion of the body and forming a closed bottom of the ammunition assembly; and a propellant bed contained in the body and intermediate the projectile and the base.

2. The assembly of claim 1 wherein the body is a fully consumable body comprised of approximately 60%-67% energetic material, 25% fibrous material, and 8-15% additives.

3. The assembly of claim 1 wherein the fibrous material comprises abaca hemp fibers or Kraft paper fibers.

4. The assembly of claim 1 wherein the other energetic material comprises nitrocellulose, RDX, or HMX.

5. The assembly of claim 1 wherein the body is a molded body configured to receive the projectile at the first end portion and to connect to the base at the second end portion.

6. The assembly of claim 1 wherein the body is a two piece body having a proximal component adjacent to the projectile and a distal component adjacent to the base.

7. The assembly of claim 6 wherein the proximal component is fixedly interconnected to the distal component at a joint area formed by a skive joint.

8. The assembly of claim 1 wherein the first end portion has engaging features for engaging the projectile, wherein the engaging features comprise hangers, threads, holes, grooves, or notches.

9. The assembly of claim 1, further comprising a structural member disposed within the body and physically interconnecting the projectile and the base to isolate the body from loads therebetween.

10. A consumable ammunition assembly, comprising:

a projectile;

a molded, consumable cartridge body having a first end portion connected to the projectile, and the body having a second end opposite the first end, wherein the body comprises nitroguanidine-based energetic material, and approximately 20%-30% non-energetic, fibrous material, and wherein the energetic material comprises approximately 90%-100% nitroguanidine;

a non-combustible base connected to the second end portion of the body and forming a closed bottom of the ammunition assembly; and a propellant bed contained in the body and intermediate the projectile and the base.

11. The assembly of claim 10 wherein the body is a fully consumable body comprised of approximately 60%-67% energetic material, and 20%-30% non-energetic, fibrous material.

12. The assembly of claim 10 wherein the non-energetic fibrous material comprises abaca hemp fibers or Kraft paper fibers.

13. The assembly of claim 10 wherein the other energetic material comprises nitrocellulose, RDX, or HMX.

14. The assembly of claim 10 wherein the body is a molded body configured to receive the projectile at the first end portion and to connect to the base at the second end portion.

15. The assembly of claim 10 wherein the body is a two piece body having a proximal component adjacent to the projectile and a distal component adjacent to the base.

16. The assembly of claim 10 wherein the first end portion has engaging features for engaging the projectile, wherein the engaging features comprise hangers, threads, holes, grooves, or notches.

17. The assembly of claim 10, further comprising a structural member disposed within the body and physically interconnecting the projectile and the base to isolate the body from loads therebetween.

* * * * *